US009244377B2

(12) United States Patent
Shukuri

(10) Patent No.: US 9,244,377 B2
(45) Date of Patent: Jan. 26, 2016

(54) DEVELOPER ROLLER, AND IMAGE FORMING APPARATUS INCLUDING THE DEVELOPER ROLLER

(71) Applicant: Samsung Electronics Co., Ltd., Suwon-si, Gyeonggi-do (KR)

(72) Inventor: Katsuhiro Shukuri, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 224 days.

(21) Appl. No.: 13/910,209

(22) Filed: Jun. 5, 2013

(65) Prior Publication Data

US 2014/0227011 A1 Aug. 14, 2014

(30) Foreign Application Priority Data

Feb. 8, 2013 (KR) ..... 10-2013-0014654

(51) Int. Cl.
*G03G 15/08* (2006.01)

(52) U.S. Cl.
CPC ..... *G03G 15/0818* (2013.01); *G03G 15/0808* (2013.01)

(58) Field of Classification Search
CPC ..... G03G 15/0808; G03G 2215/0619; G03G 15/0818
USPC ..... 399/286
See application file for complete search history.

(56) References Cited

U.S. PATENT DOCUMENTS 4,628,860 A * 12/1986 Hosoya et al. ..... 399/252

FOREIGN PATENT DOCUMENTS

| | | | |
|---|---|---|---|
| JP | 9-15979 | 1/1997 | |
| JP | 09274374 A * | 10/1997 | ..... G03G 15/08 |
| JP | 11-7150 | 1/1999 | |
| JP | 2000-56557 | 2/2000 | |
| JP | 2003-211587 | 7/2003 | |
| JP | 2008-51962 | 3/2008 | |

OTHER PUBLICATIONS

Machine translation of JP09-274374.*
Extended European Search Report dated Aug. 14, 2014 in corresponding European Patent Application No. 13170174.0.

* cited by examiner

*Primary Examiner* — David Gray
*Assistant Examiner* — Andrew V Do
(74) *Attorney, Agent, or Firm* — Staas & Halsey LLP

(57) ABSTRACT

A developer roller is spaced apart by a developing gap from a photosensitive medium and supplies toner to an electrostatic latent image formed on the photosensitive medium to develop the electrostatic latent image. The developer roller includes a core and at least one material layer formed on an outer circumference of the core. A ten-point average roughness of an outermost layer in the material layer is 5-15% of the developing gap.

10 Claims, 5 Drawing Sheets

DEVELOPER ROLLER, AND IMAGE FORMING APPARATUS INCLUDING THE DEVELOPER ROLLER

CROSS-REFERENCE TO RELATED APPLICATIONS

This application claims priority under 35 U.S.C. §119 from Korean Patent Application No. 10-2013-0014654, filed on Feb. 8, 2013, in the Korean Intellectual Property Office, the disclosure of which is incorporated herein in its entirety by reference.

BACKGROUND OF THE INVENTION

1. Field of the Invention

The present general inventive concept relates to a developer roller that transfers toner to a photosensitive medium and develops an electrostatic latent image on the photosensitive medium, a method of manufacturing the developer roller, and an image forming apparatus including the developer roller.

2. Description of the Related Art

In an image forming apparatus using an electrophotographic method, a light beam is irradiated onto a photosensitive medium charged with a uniform electric potential to form an electrostatic image, and a toner of a predetermined color is supplied through a developer roller to the electrostatic latent image to develop the electrostatic image.

The developer roller is an important member that affects the image quality. To form a background free of contamination and secure a proper image concentration, a developer roller having a good toner transfer capability is needed. To keep up with the demands on high-quality pictures, a spherical polymerization toner has been recently employed instead of a pulverized toner. A developer roller that may transfer a spherical polymerization toner with good efficiency is required.

SUMMARY OF THE INVENTION

The present general inventive concept provides a developer roller that may enhance a transfer efficiency of a spherical toner having a small particle diameter, a method of manufacturing the developer roller, and an image forming apparatus including the developer roller.

The present general inventive concept also provides a developer roller which prevents the occurrence of a discharge in a developing gap between the developer roller and a photosensitive medium, a method of manufacturing the developer roller, and an image forming apparatus including the developer roller.

The present general inventive concept also provides a developer roller which prevents the periodical occurrence of white or black spots in an image during a rotation thereof, a method of manufacturing the developer roller, and an image forming apparatus including the developer roller.

Additional features and utilities of the present general inventive concept will be set forth in part in the description which follows and, in part, will be obvious from the description, or may be learned by practice of the general inventive concept.

Exemplary embodiments of the present general inventive concept provide a developer roller which is spaced apart by a developing gap from a photosensitive medium to supply one-component toner to an electrostatic latent image formed on the photosensitive medium to develop the electrostatic latent image, the developer roller including a core, and a material layer formed on an outer circumference of the core, wherein a ten-point average roughness of an outermost layer in the material layer is about 5-15% of a width of the developing gap.

The outermost layer of the material layer is a coating layer, and the coating layer may include beads having a diameter of about 5-15% of the width of the developing gap.

An elastic layer may be provided between the coating layer and the core.

The beads may be at least one type selected from the group consisting of an acrylic resin particle containing a PMMA particle, a silica particle, a urethane resin particle, a polyamide resin particle, and a fluorine resin particle.

A base resin of the coating layer may include a urethane resin.

Exemplary embodiments of the present general inventive concept provide an image forming apparatus using a non-magnetic, one-component toner, including a photosensitive medium on which an electrostatic latent image is formed, and a developer roller spaced apart from the photosensitive medium by a developing gap, the developer roller supplying toner to the electrostatic latent image to develop the electrostatic latent image, the developer roller including a core, and at least one material layer formed on an outer circumference of the core, wherein a ten-point average roughness of an outermost layer in the material layer is about 5-15% of a width of the developing gap.

The outermost layer of the developer roller may be a coating layer, and the coating layer may include beads having a diameter of about 5-15% of a width of the developing gap.

The elastic layer may be positioned between the coating layer and the core.

The beads may be at least one selected from the group consisting of an acrylic resin particle containing a PMMA particle, a silica particle, a urethane resin particle, a polyamide resin particle, and a fluorine resin particle.

The base resin of the coating layer may include a urethane resin.

Exemplary embodiments of the present general inventive concept provide an image forming apparatus including a photosensitive medium to carry an electrostatic latent image, and a developer roller to supply toner to the electrostatic image, the developer roller having a ten-point average surface roughness of about 5-15% of a width of a developing gap between the developer roller and the photosensitive medium.

The image forming apparatus may further include a gap maintaining member to maintain the width of the developing gap between the photosensitive medium and the developer roller at a constant value.

The image forming apparatus may further include a layer regulation member to maintain the thickness of toner attached to the developer roller at a constant value.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE EMBODIMENTS

Figure 1:
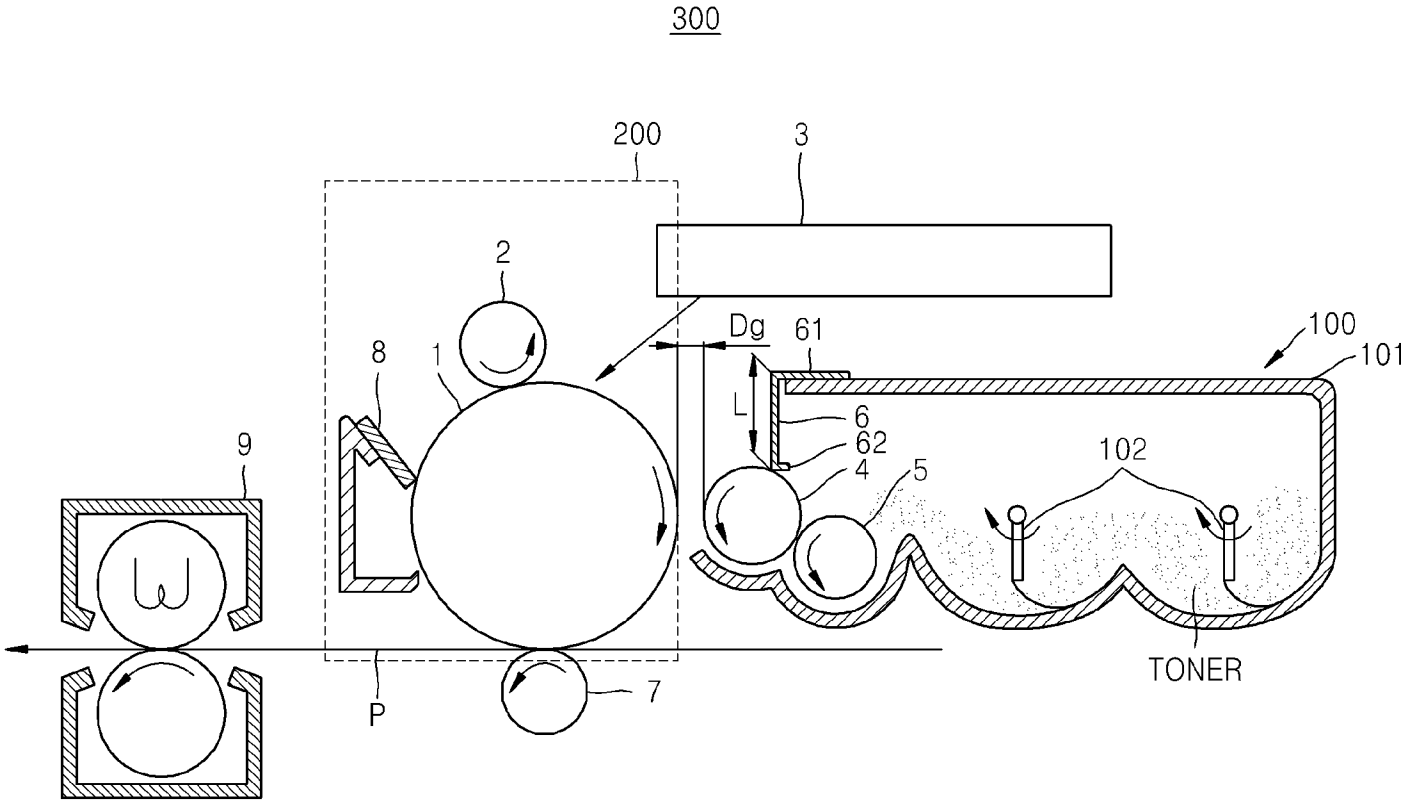
FIG. 1 is a schematic view illustrating an image forming apparatus according to an exemplary embodiment of the present general inventive concept.

As used herein, the term "and/or" includes any and all combinations of one or more of the associated listed items. Expressions such as "at least one of," when preceding a list of elements, modify the entire list of elements and do not modify the individual elements of the list.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Figure 2:
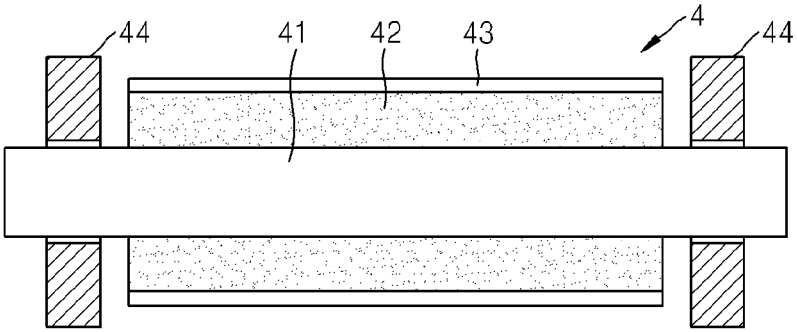
FIG. 2 is a cross-sectional view illustrating a developer roller according to an exemplary embodiment of the present general inventive concept.

FIG. 1 is a schematic view of an exemplary embodiment of an electrophotographic image forming apparatus 300 according to an exemplary embodiment of the present general inventive concept. FIG. 2 is a cross-sectional view of an exemplary embodiment of a developer roller 4 of the electrophotographic image forming apparatus of FIG. 1 according to an exemplary embodiment of the present general inventive concept. Referring to FIG. 1, a photosensitive drum 1 is an example of a photosensitive medium on which an electrostatic latent image is formed. The photosensitive drum 1 may include, for example, a conductive metal core (not illustrated), and a photo-conductive material layer (not illustrated) formed on an outer circumference thereof. The photo-conductive material layer is a material layer which operates as an insulator having a high resistance in a dark environment, and when exposed to light, reduces a resistance of the exposed portion, partially changing to a conductor state. The photosensitive material layer may be, for example, an organic photoconductor layer. The photosensitive drum 1 may be replaced by a belt type photosensitive medium (not illustrated).

A charge roller 2 is an example of a charger to charge a surface of the photosensitive drum 1 to a uniform potential. The charge roller 2 may rotate in contact with the photosensitive drum 1. A charge bias voltage is applied to the charge roller 2. The charge roller 2 may be replaced by a corona discharger (not illustrated).

An exposure unit 3 irradiates light modified according to image information onto the photosensitive drum 1 to form an electrostatic latent image. For example, a laser scanning unit (LSU) which scans light irradiated from a laser diode (not illustrated) in a main scanning direction by using a polygon mirror may be employed as the exposure unit 3.

The developer roller 4 supplies a toner accommodated in a housing 101 to the electrostatic latent image formed on the photosensitive drum to develop the electrostatic latent image, thereby forming a toner image on the surface of the photosensitive drum 1. The toner adheres to a surface of the developer roller 4 and is transferred thereby to the electrostatic latent image. In order for the toner transferred by the developer roller 4 to be uniformly attached to the electrostatic latent image and to develop the electrostatic latent image, it is necessary to charge the toner and supply the charged toner to the electrostatic latent image. Examples of a method of charging a toner include a two-component method in which a toner is charged by mixing and agitating a carrier (not illustrated) and the toner within the housing 101, and a one-component method in which a toner is charged by a friction with another member in the housing 101, for example a supply roller 5 and/or a layer regulation member 6, described later.

In the two-component method, a toner concentration control is required to maintain a mixing ratio of the carrier and toner at a predetermined value. Also, the developer roller 4 needs to generate a magnetic force so as to carry the carrier. Thus, a two-component type image forming apparatus is generally larger and more expensive than a one-component type image forming apparatus.

Since the one-component type image forming apparatus charges a toner by a friction of the toner on the developer roller 4 with a supply roller 5 and/or a layer regulating member 6, it may be miniaturized and manufactured at low costs, compared with the two-component type image forming apparatus.

The one-component type image forming apparatus may be classified into a magnetic one-component type image forming apparatus and a non-magnetic one-component type image forming apparatus. Generally, the non-magnetic one-component type image forming apparatus is frequently employed to produce high quality picture and colorization. The one-component type image forming apparatuses may also be classified into a contact type image forming apparatus and a non-contact type image forming apparatus according to an arrangement relationship between the developer roller 4 and the photosensitive medium (corresponding to the photosensitive drum 1). The contact type image forming apparatus is an apparatus in which the developer roller 4 contacts the photosensitive medium to perform image development, and has limitations, such as wear of the developer roller 4 and the photosensitive medium, an increase in a driving torque, contamination of a photosensitive medium surface due to the developer roller 4, and occurrence of image spots in the form of a horizontal band due to prolonged contact between the developer roller 4 and the photosensitive medium.

In consideration of the above-mentioned matters, the image forming apparatus 300 of the present exemplary embodiment is a non-magnetic, non-contact, one-component developing type image forming apparatus.

Referring to FIG. 2, the developer roller 4 includes a core 41 and one or more material layers formed on an outer circumference of the core 41. For example, the material layers formed on the core 41 may include an elastic layer 42 and a coating layer 43 formed on an outer circumference of the elastic layer 42. The coating layer 43 may be the outermost material layer. The core 41 may be, for example, a shaft made of a metal, such as aluminium, stainless steel, or the like. The elastic layer 42 may be, for example, a rubber layer, such as an acrylonitrile-butadiene rubber layer, a urethane layer, a silicon layer, or the like. The coating layer 43 will be described in detail later.

Figure 3:
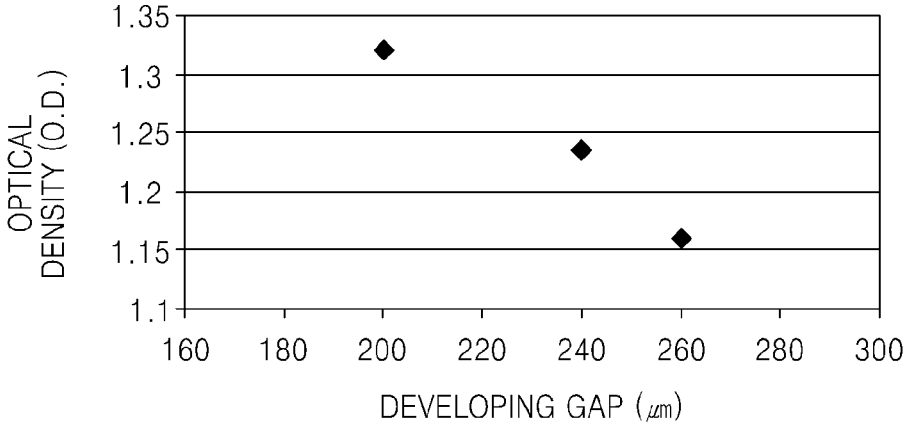
FIG. 3 is a graph illustrating an example of changes in image density with a change in a width of a developing gap.

The developer roller 4 is disposed such that the surface thereof is spaced apart by a developing gap (Dg, illustrated in FIG. 1) from the surface of the photosensitive drum 1. A width of the developing gap Dg may be, for example, in a range of a few ten microns to a few hundred microns. When the developing gap Dg is too small, a dimensional tolerance and assembly tolerance are very tight so that a cost increase may be caused, and when the developing gap Dg is too large, a developing potential between the developer roller 4 and the photosensitive drum 1 becomes so small that the image density of a developed image may be too low. FIG. 3 is a graph showing test results of image density of developed images according to the size of the developing gap Dg. In FIG. 3, the vertical axis indicates an optical density (O.D.) corresponding to the image density. As apparent from FIG. 3, the image density decreases as the width of the developing gap Dg increases. Referring to FIG. 2, a gap ring 44 may be disposed at both sides of the core 41 so as to maintain the developing gap Dg at a constant value. A radius of the gap ring 44 is larger than a radius of the developer roller 4 by the width of the developing gap Dg. The gap ring 44 may be coupled to the core 41 so as to be rotatable by the core 41. An elastic force is applied to the developer roller 4 and the photosensitive drum 1 by an elastic member (not illustrated). As the gap ring 44 contacts the surface of the photosensitive drum 1, an interval between the surface of the developer roller 4 and the surface of the photosensitive drum 1, i.e., the developing gap Dg, may be maintained constant by the interference of the gap ring 44.

A developing bias voltage including an AC voltage and a DC voltage that overlap may be applied to the developer roller 4. The toner on the developer roller 4 is separated from the developer roller 4 by an AC potential and is attached to the electrostatic latent image formed on the surface of the photosensitive drum 1 by a DC potential.

Referring to FIG. 1, the image forming apparatus 300 may further include a supply roller 5. The supply roller 5 charges the toner by a friction of the toner between the supply roller 5 and the developer roller 4, while supplying the toner in the housing 101 to the developer roller 4. A supply bias voltage to charge the toner may be applied to the supply roller 5. The supply roller 5 may contact the developer roller 4, and may be spaced apart by a predetermined interval from the developer roller 4. The supply roller 5 may include a metal core (not illustrated) and a foam elastic layer (not illustrated) formed of, for example, foam urethane, foam silicon, or the like on an outer circumference of the metal core. The toner supply performance may be improved by allowing toner to be received in a cell formed in the foam elastic layer of the supply roller 5 and then supplying the received toner to the developer roller 4.

The layer regulating member 6 is disposed at a downstream side of the supply roller 5 with respect to a rotational direction of the developer roller 4. The layer regulating member 6 charges the toner while contacting the outer circumference of the developer roller 4 to regulate the thickness of a toner layer attached to the outer circumference of the developer roller 4. When the amount of the toner carried to the developing gap Dg is too large, the toner may not be sufficiently charged by frictional charging, and thus, the charged amount of toner decreases. Thus, developing the electrostatic latent image to a sufficient image density becomes difficult, and defects, such as toner attachment to the image background, an increase in toner consumption, contamination of the image forming apparatus 300 due to the flight of the toner, etc., may be caused. When the amount of the toner carried to the developing gap Dg is too small, a sufficient image density may not be obtained, and the characteristics of the toner may be easily lost due to a mechanical stress applied to the toner. Therefore, the thickness of the toner layer attached onto the outer circumference of the developer roller 4 is regulated by using the layer regulating member 6. The layer regulating member 6 may be manufactured, for example, of stainless steel sheet, phosphor bronze steel sheet, or the like. It may be possible to regulate the toner layer on the outer circumference of the developer roller 4 to a desired thickness by controlling the thickness of the layer regulating member 6, the length (free length: L) from a support portion 61 supported in the housing 101 to a contact portion 62 contacting the developer roller 4, and the like. Two agitators 102 agitating the toner in the housing 101 and carrying the agitated toner toward the developer roller 4 and the supply roller 5 may be disposed in the housing 101. Although two agitators 102 are illustrated in FIG. 1, one, three, or more agitators 102 may be employed.

A transfer roller 7 is an example of a transfer unit to transfer a toner image formed on the photosensitive drum 1 to a recording medium (P). A transfer bias voltage is applied to the transfer roller 7. The transfer bias voltage may have an opposite polarity to the charged polarity of the toner. The transfer roller 7 may be replaced by a corona transfer unit (not illustrated).

The toner image transferred to the recording medium P is maintained on the recording medium P by an electrostatic attractive force. A fusing unit 9 fuses the toner image on the recording medium P by applying heat and pressure to the toner image to melt the toner image.

A cleaning member 8 removes the toner remaining on the surface of the photosensitive drum 1 after the transferring of the toner image is completed. The cleaning member 8 may be, for example, an elastic blade which contacts the surface of the photosensitive drum 1 to scrape the remaining toner.

The developer roller 4, the supply roller 5, and the layer regulating member 6 may be installed in the housing 101 to constitute a developing unit 100. Also, the photosensitive drum 1, the charge roller 2, and the cleaning blade 8 may be installed in a frame (not illustrated) to constitute a photosensitive unit 200. Accordingly, when the periods of use of the developer unit 100 and the photosensitive unit 200 have expired, the developer unit 100 and the photosensitive unit 200 may be individually replaced. Alternatively, the developer unit 100 and the photosensitive unit 200 may be connected to each other and replaced as one unit.

Operations of the image forming apparatus 300 according to the above-described configuration will be briefly described below.

[Charge]: When a printing command is inputted from a host (not illustrated), a charge bias voltage is applied to the charge roller 2. While the charge roller 2 contacts the photosensitive drum 1 and rotates, the surface of the photosensitive drum 1 is charged to a uniform potential, for example, −600V.

[Exposure]: The exposure unit 3 irradiates light onto the photosensitive drum 1, the light having been modified corresponding to image information. On the surface of the photosensitive drum 1, the potential of a portion where the light is irradiated becomes, for example, −50V, and the potential of a portion where light is not irradiated is maintained at −600V. Thus, an electrostatic latent image is formed on the surface of the photosensitive drum 1.

[Development]: The toner in the housing 101 is carried by the agitator 102 to a region where the developer roller 4 and the supply roller 5 are installed. The toner is charged by friction between the supply roller 5 and the developer roller 4. The toner is attached on the outer circumference of the developer roller 4 by a supply potential formed between the supply roller 5 and the developer roller 4 as well as an electrostatic force, and thus, a toner layer is formed on the developer roller 4. As the developer roller 4 rotates, the toner layer is carried to a region where the layer regulating member 6 contacts the developer roller 4. The toner layer is regulated to a desired thickness by the layer regulating member 6. Also, while passing through the contact region, the toner is charged by friction with the layer regulating member 6. As the developer roller 4 rotates, the regulated toner layer is carried to a developing region where the developer roller 4 and the photosensitive drum 1 form the developing gap Dg and face each other. A developing potential caused by a developing bias voltage applied to the developer roller 4 is formed between the developer roller 4 and the photosensitive drum 1, and the toner is separated from the developer roller 4 by the formed developing potential and then attached on the electrostatic latent image formed on the surface of the photosensitive drum 1 across the developing gap Dg. Thus, a toner image is formed on the surface of the photosensitive drum 1.

[Transfer]: As the photosensitive drum 1 rotates, the toner image is carried to a transfer region where the photosensitive drum 1 and the transfer roller 7 face each other and the recording medium P passes between the photosensitive drum 1 and the transfer roller 7. The toner image is transferred to the recording medium P by a transfer potential formed by a transfer bias voltage applied to the transfer roller 7.

[Fusing]: The recording medium P having the toner image transferred thereon is transferred to the fusing unit 9. While passing through the fusing unit 9, the toner image is melted by heat and the melted toner image is fused onto the surface of the recording medium P by pressure applied thereon, thereby completing printing.

[Cleaning]: The toner not transferred to the recording medium P and remaining on the surface of the photosensitive drum 1 is removed by the cleaning member 8.

To secure a good toner-carrying performance, the surface of the developer roller 4 may have an irregular shape. The irregular shape may be formed by grinding the outer circumference of the elastic layer 41. As demands for high quality pictures have recently increased, a polymerization toner is employed instead of a pulverization toner. Particles of polymerization toner has a uniform shape close to a sphere, as compared with the pulverization toner. Also, the particles of the polymerization toner have a diameter range of about 5-7 μm, which is smaller than the diameter of particles of the pulverization toner having a diameter range of about 7-8 μm. Therefore, a sufficient toner carrying performance may not be secured only by grinding the surface of the developer roller 4.

Figure 4:
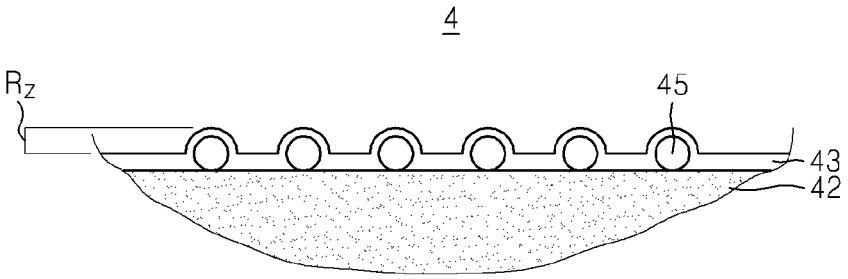
FIG. 4 is a partial detailed cross-sectional view illustrating an exemplary embodiment of the developer roller illustrated in FIG. 2.

FIG. 4 is a detailed partial cross-sectional view of the developer roller 4. Referring to FIG. 4, a coating layer 43 containing beads 45 is provided onto an outer circumference 42 of the developer roller 4 according to the present exemplary embodiment. Due to the beads 45 contained in the coating layer 43, an irregular surface is formed on the surface of the developer roller 4, and thereby a surface roughness (Rz) to carry the toner may be secured. The coating layer 43 may be formed by coating a coating solution including the beads 45 dispersed in a base resin on the outer circumference of the elastic layer 42, for example, by a spray method, or the like. The base resin may be, for example, a urethane resin. The beads 45 may be, for example, acrylic resin particles such as poly-methylmethacrylate (PMMA), or the like, silica particles, urethane resin particles, polyamide resin particles, and fluorine resin particles. The beads 45 may be any type of the particles presented above, or may include two or more types of the particles presented above.

A hardener, a conductor, or the like may be further dispersed in the base resin. Examples of a disperser to uniformly disperse the beads 45 and an additive such as a hardener, a conductor, or the like in the base resin may include, for example, a paint shaker, a magnetic stirrer, a propeller agitator, a beadsmill, and the like. The dispersing time may be properly adjusted. Prior to the coating, the coating solution may be filtered using a sieve such that large diameter beads 46 and aggregate beads 47 (illustrated in FIG. 5) in the coating solution are separated.

Figure 5:
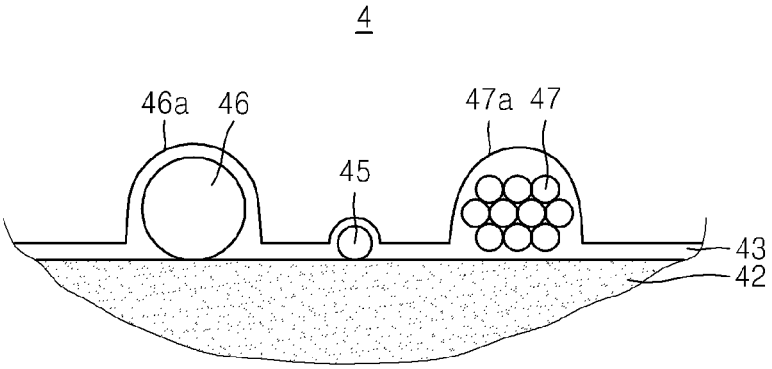
FIG. 5 is a schematic view illustrating protruded portions due to a large diameter particle and aggregated particles.

To secure a uniform toner carrying performance, it is required that the irregular surface formed on the surface of the developer roller 4 have a predetermined uniformity. For example, as illustrated in FIG. 5, when a protruded portion 46*a* by a large diameter bead 46, or a protruded portion 47*a* by aggregation of aggregate beads 47 is formed on the surface of the developer roller 4, a distance between the protruded portion 46*a* or 47*a* and the surface of the photosensitive drum 1 becomes smaller, so that a discharge may be generated between the protruded portion 46*a*, 47*a* and the surface of the photosensitive drum 1. Due to the discharge, the potential in the surface of the photosensitive drum 1 is changed, so that a white spot or a black spot may occur periodically on the developed image during the rotation of the developer roller 4. The discharge may be more easily generated in a high humidity environment.

Figure 6:
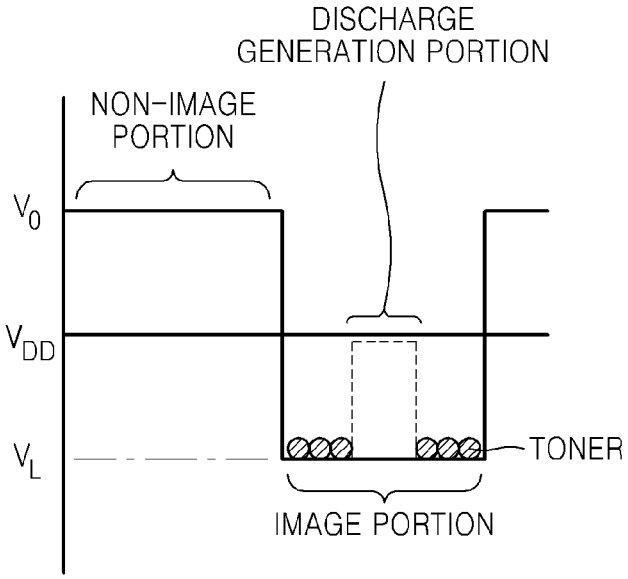
FIG. 6 is a schematic view illustrating the occurrence of a white spot on a printed image due to a discharge in a developing gap.

The white spot indicates that the toner is not attached to an image portion of the electrostatic latent image, and thus, a developed image is not completely formed. For example, FIG. 6 is a schematic view illustrating the occurrence of a white spot. Referring to FIG. 6, the surface potential of the photosensitive drum 1 charged by the charge roller 2 is $V_0$, and when light modified according to image information is irradiated onto the surface of the photosensitive drum 1 by the exposure unit 3, the potential of a portion where the light is irradiated becomes $V_L$. Thus, an electrostatic latent image is formed on the surface of the photosensitive drum 1. The portion where the surface potential is $V_0$ is a non-image portion of the electrostatic latent image, and the portion where the surface potential is $V_L$ is an image portion of the electrostatic latent image. The value of a DC voltage, i.e., $V_{DD}$, of a developing bias voltage is between $V_0$ and $V_L$. That is, an absolute value of $V_{DD}$ is between an absolute value of $V_0$ and an absolute value of $V_L$. Due to a potential difference between the potential of the image portion and the DC voltage of the developing bias voltage, i.e., a developing voltage difference, the toner is attached on the image portion so that the electrostatic latent image is developed. When a discharge is generated in a region corresponding to the image portion as illustrated in FIG. 6, a potential of the region becomes similar to $V_{DD}$, and thus, the developing potential difference is greatly lowered. The toner is attached toward a portion where the developing potential difference is relatively high, i.e., toward the image portion where a discharge is not generated, and is not attached to a portion where the discharge is generated. As a result, a white spot where no image is included occurs on the developed image, as illustrated by the dashed box in FIG. 6.

Figure 7:
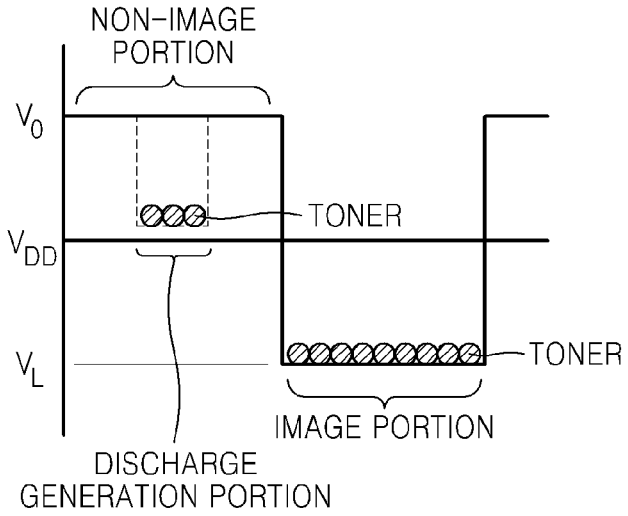
FIG. 7 is a schematic view illustrating the occurrence of a black spot on a printed image due to a discharge.

A black spot indicates that the toner is attached to the non-image portion of the electrostatic latent image, and thus, the background is contaminated. For example, FIG. 7 is a schematic view illustrating the occurrence of a black spot. Since the potential polarity of the non-image portion is the same as the charged polarity of the toner, even though the developing bias voltage is applied, the toner is not attached to the non-image portion but is attached to the image portion having the relatively opposite polarity. However, when a discharge is generated in a region corresponding to the non-image portion, the potential of the region becomes almost equal to $V_{DD}$. Then, the toner which is not attached to the non-image portion due to repulsion by a repulsive force, may be attached to a portion where the repulsive force is relatively weak. Thus, the toner is attached to the background of the developed image, so that a black spot occurs, as illustrated by the dashed box in FIG. 7.

According to the present exemplary embodiment, by setting the surface roughness (Rz) of the developer roller 4 to be about 5-15% of the width of the developing gap Dg, a good toner carrying performance may be secured. Also, an image failure due to occurrence of a black spot and/or a white spot may be prevented by preventing the occurrence of a discharge in the developing gap Dg.

Example 1

Surface charged potential of photosensitive drum 1 (Potential of non-image portion): −600V Potential of image portion ($V_L$): −50V Developing gap (Dg) width: 200 μm Developing bias voltage: AC 1.8 kV-3.2 kHz, DC −300 V Developer roller 4: Surface roughness (ten-point average roughness) Rz 15-20 μm, Resistance $5\times10^4$-$2\times10^6\Omega$.

Supply roller 5: Roller having a urethane foam elastic layer

Layer regulating member 6: Stainless steel plate having a thickness of 70 μm, free length 100 mm The developer roller 4 included an NBR elastic layer 42 formed on a stainless steel core 41, and a coating layer 43 formed on the NBR elastic layer 42 by coating the NBR elastic layer 42 with a coating solution containing PMMA particles dispersed in a urethane resin, is used. To obtain a surface roughness (ten-point average roughness) Rz of 15-20 μm, PMMA particles having an average diameter of about 15-20 μm were used. Solid images were formed by using 20 developer rollers 4 which were left undone in an environment of high temperature and high humidity (HH), normal temperature and normal humidity (NN), and low temperature and low humidity (LL) for three days, and it was tested whether or not a white spot occurred. The test results are shown in Table 1.

TABLE 1

| Height of protruded portion formed by beads (μm) | 25 or less | 26-35 | 36-45 | 46-55 | 56 or more |
|---|---|---|---|---|---|
| HH | 0 | 0 | 4 | 2 | 1 |
| NN | 0 | 0 | 0 | 2 | 1 |
| LL | 0 | 0 | 0 | 0 | 0 |

In Table 1, "0" means that a white spot did not occur in the solid image. As listed in Table 1, it was confirmed that a white spot occurred 7 times periodically during the rotation of the developer roller 4 in the environment of high temperature and high humidity (HH). The surface of the developer roller 4, which was confirmed to have a white spot, was observed using a microscope, and it was confirmed that the surface has a protruded portion of about 40-60 μm. Regarding the developer roller 4 where a white spot did not occur, the size of a protruded portion on the surface thereof was not higher than about 30 μm. Accordingly, since the developing gap Dg is about 200 μm, it is known that the occurrence of a white spot may be prevented by setting the protruded amount of the irregular surface on the surface of the developer roller 4 to be about 15% or less of the width of the developing gap Dg. At this time, the surface roughness (Rz) of the developer roller 4 was also about 15% or less of the width of the developing gap Dg. The above-described surface roughness Rz of the developer roller 4 might be realized by setting the diameter of the beads 45 to about 15% or less of the width of the developing gap Dg, and sufficiently dispersing the beads 45 in the coating solution.

Figure 8:
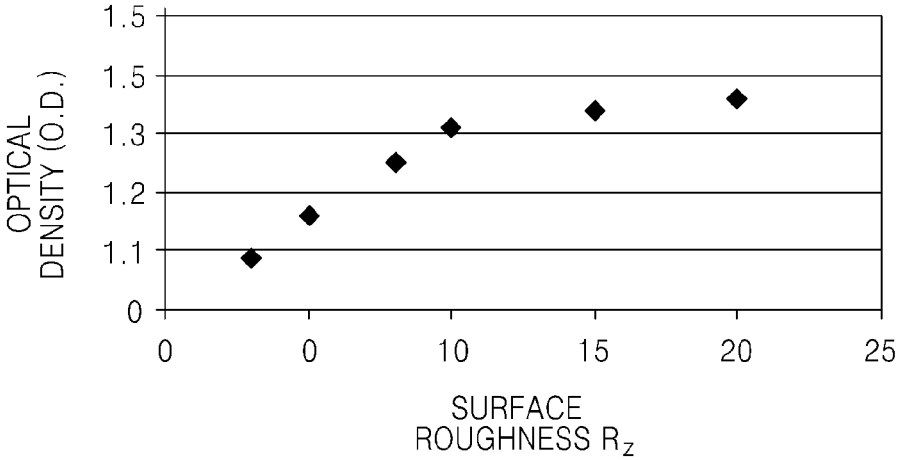
FIG. 8 is a graph illustrating an example of a relationship between a surface roughness of a developer roller and an image concentration.

The lower limit of the surface roughness Rz in the developer roller 4 may be related to the toner carrying performance. For example, FIG. 8 is a graph showing a test result regarding the relationship between the surface roughness Rz of the developer roller 4 and the optical density of the developed image. Referring to FIG. 8, the surface roughness Rz needs to be about 10 μm or more so as to obtain a sufficient optical density (O.D.) of not less than about 1.3. Therefore, the lower limit of the surface roughness Rz in the developer roller 4 needs to be about 5% or more of the width of the developing gap Dg. To obtain such a surface roughness Rz, the diameter of the beads 45 may be about 5% or more of the width of the developing gap Dg.

Accordingly, it is known that a sufficient toner carrying performance may be secured and the occurrence of a white spot or a black spot due to a discharge in the developing gap Dg may be prevented by setting the surface roughness Rz of the developer roller 4 to be 5-15% of the width of the developing gap Dg. To obtain such a surface roughness Rz, the diameter of the beads 45 may be set to about 15% or more of the width of the developing gap Dg.

To manufacture the developer roller 4 having a uniform surface roughness Rz, large diameter beads 46 may be removed before the coating solution is coated on the outer circumference of the elastic layer 42. Although the beads 45 are uniformly dispersed in the coating solution by using the disperser, since aggregate beads 47 may be generated, the aggregate beads 47 may be removed before the coating solution is coated on the outer circumference of the elastic layer 42. For this purpose, a sieve may be used.

Example 2

Developer rollers 4 were manufactured by passing a coating solution prepared under the condition of Example 1 through a 300 mesh, a 600 mesh, and an 800 mesh, respectively, and coating the coating solution on the outer circumference of the elastic layer 42 of each of the developer rollers 4. A dispersing time of the coating solution was about 4 hours. By using the above-described respective meshes, 20 developer rollers 4 were manufactured, and solid images were printed in an environment of high temperature and high humidity using the manufactured developer rollers 4, and whether or not a white spot occurred was tested. The test results are shown in Table 2.

TABLE 2

| Metal mesh | 300 mesh | 600 mesh | 800 mesh |
|---|---|---|---|
| Mesh opening size | 45 μm | 20 μm | 16 μm |
| Image evaluation result | 7 | 3 | 0 |

The image evaluation result shows the occurrence frequency of a white spot. As apparent from Table 2, no image failure occurred when the developer roller 4 was manufactured by removing large diameter beads 46 and aggregate beads 47 by using the 800 mesh.

Example 3

Beads 45 need to be uniformly dispersed in the coating solution so as to prevent occurrence of aggregate beads 47 that cause a white spot or a black spot. Also, a conductor may be further dispersed in the coating solution. When the conductor is insufficiently dispersed, a resistance spot occurs on the outer circumference of the developer roller 4, so that an image spot may occur on the developed image. Table 3 shows a test result as to whether or not an image failure occurs according to a dispersion time. The condition of the coating solution was the same as that in Example 1 and an 800 mesh was used.

TABLE 3

| Dispersion time | 2 hours | 4 hours | 12 hours | 24 hours |
|---|---|---|---|---|
| Image evaluation result in HH environment | 1/20 | 0 | 0 | 0 |

As apparent from Table 3, when the 800 mesh was used and dispersion was performed for 4 hours, no image failure occurred.

While the above examples describe image forming apparatuses 300 forming a monochromatic image, the scope of the present general inventive concept is not limited thereto. The developer roller 4 according to exemplary embodiments of the present general inventive concept may be also applied to a single-pass type or multi-pass type color image forming apparatus using, for example, cyan, magenta, yellow, and black colors.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A developer roller which is spaced apart by a developing gap from a photosensitive medium and supplies one-component toner to an electrostatic latent image formed on the photosensitive medium to develop the electrostatic latent image, the developer roller comprising:

a core; and at least one material layer formed on an outer circumference of the core, wherein an outermost layer of the material layer is a coating layer that includes beads having a diameter of about 5-15% of a width of the developing gap such that a ten-point average roughness of the outermost layer in the material layer is about 5-15% of the width of the developing gap.

2. The developer roller of claim 1, wherein an elastic layer is provided between the coating layer and the core.

3. The developer roller of claim 1, wherein the beads are at least one selected from the group consisting of an acrylic resin particle containing a PMMA particle, a silica particle, a urethane resin particle, and a fluorine resin particle.

4. The developer roller of claim 3, wherein a base resin of the coating layer comprises a urethane resin.

5. An image forming apparatus using a non-magnetic, one-component toner, comprising:

a photosensitive medium on which an electrostatic latent image is formed; and a developer roller spaced apart from the photosensitive medium by a developing gap, the developer roller supplying toner to the electrostatic latent image to develop the electrostatic latent image, the developer roller comprising:

a core; and at least one material layer formed on an outer circumference of the core, wherein an outermost layer of the developer roller is a coating layer and the coating layer comprises beads having a diameter of about 5-15% of a width of the developing gap such that a ten-point average roughness of the outermost layer in the material layer is about 5-15% of the width of the developing gap.

6. The image forming apparatus of claim 5, wherein an elastic layer is positioned between the coating layer and the core.

7. The image forming apparatus of claim 5, wherein the beads are at least one selected from the group consisting of an acrylic resin particle containing a PMMA particle, a silica particle, a urethane resin particle, a polyamide resin particle, and a fluorine resin particle.

8. The image forming apparatus of claim 7, wherein a base resin of the coating layer comprises a urethane resin.

9. The image forming apparatus of claim 8, further comprising:

a gap maintaining member to maintain the width of the developing gap between the photosensitive medium and the developer roller at a constant value.

10. The image forming apparatus of claim 5, further comprising:

a layer regulation member to maintain the thickness of toner attached to the developer roller at a constant value.

* * * * *

UNITED STATES PATENT AND TRADEMARK OFFICE

CERTIFICATE OF CORRECTION

PATENT NO. : 9,244,377 B2
APPLICATION NO. : 13/910209
DATED : January 26, 2016
INVENTOR(S) : Katsuhiro Shukuri It is certified that error appears in the above-identified patent and that said Letters Patent is hereby corrected as shown below:

Claims

Column 12, Line 38, Claim 9
Delete "claim 8," and insert -- claim 5, --, therefor.

Signed and Sealed this
Fourteenth Day of June, 2016

Michelle K. Lee

Michelle K. Lee
*Director of the United States Patent and Trademark Office*